US011812809B2

(12) United States Patent
McDermott

(10) Patent No.: US 11,812,809 B2
(45) Date of Patent: Nov. 14, 2023

(54) HELMET WITH EXTENDED PORTIONS CONFIGURED TO PROTECT SQUAMOUS TEMPORAL BONES OF A WEARER

(71) Applicant: Baptist Health South Florida, Inc., Coral Gables, FL (US)

(72) Inventor: Michael W. McDermott, Pinecrest, FL (US)

(73) Assignee: Baptist Health South Florida, Inc., Coral Gables, FL (US)

( * ) Notice: Subject to any disclaimer, the term of this patent is extended or adjusted under 35 U.S.C. 154(b) by 89 days.

(21) Appl. No.: 17/491,802

(22) Filed: Oct. 1, 2021

(65) Prior Publication Data

US 2022/0015487 A1 Jan. 20, 2022

Related U.S. Application Data

(63) Continuation-in-part of application No. 16/370,200, filed on Mar. 29, 2019, now abandoned.

(51) Int. Cl.
*A42B 3/06* (2006.01)

(52) U.S. Cl.
CPC ..... *A42B 3/06* (2013.01)

(58) Field of Classification Search
CPC .... A42B 3/06; A42B 3/04; A42B 3/00; A42B 3/122; A42B 3/12; A42B 3/10; A42B 3/16; A42B 3/044; A42B 3/0433; A42B 3/0406; A42B 3/0493; A42B 3/062; A42B 3/063; A42B 3/065; A42B 3/066; A42B 3/124; A42B 1/203; A42B 1/242; A42B 1/244; A42B 1/245; A42B 3/166; A42B 3/163; A42B 3/121; A42B 3/08; A42B 3/069; A42B 3/064
See application file for complete search history.

(56) References Cited

U.S. PATENT DOCUMENTS 532,567 A * 1/1895 Larwood, Jr. ..... A42B 3/08 2/421
1,868,926 A * 7/1932 Tatore ..... A42B 3/06 2/421
3,105,240 A * 10/1963 Jansson ..... A42B 3/145 2/420
3,186,004 A * 6/1965 Carlini ..... A42B 3/122 D29/106

(Continued)

*Primary Examiner* — Bao-Thieu L Nguyen
*Assistant Examiner* — Uyen T Nguyen
(74) *Attorney, Agent, or Firm* — THE WEBB LAW FIRM

(57) ABSTRACT

A helmet includes a frame having a plurality of tubular segments. The frame includes a cap portion and at least one extension portion. The cap portion includes a plurality of main tubular segments extending from a front of the helmet, configured to be positioned over a forehead of the wearer, to a back of the helmet, configured to be positioned over an occipital region of the wearer's head, and at least one tubular cross segment extending between the main segments. The at least one extension portion includes extending tubular segments that extend from the cap portion to a common point that is configured to be positioned below the wearer's ear. The helmet also includes at least one perforated cover plate mounted to the extending tubular segments, which is configured to cover the wearer's ear and squamous temporal bones of the wearer's head.

20 Claims, 9 Drawing Sheets

(56) References Cited

U.S. PATENT DOCUMENTS 3,274,612 A * 9/1966 Merriam ..... A42B 3/00 2/421
3,497,874 A * 3/1970 Molitoris ..... A42B 3/16 2/423
3,555,561 A * 1/1971 Neis ..... A42B 3/322 D29/105
3,994,022 A * 11/1976 Villari ..... A42B 3/121 2/909
4,612,672 A * 9/1986 Schrack ..... A42B 1/12 2/908
5,687,426 A * 11/1997 Sperber ..... A42B 3/066 2/413
5,745,923 A * 5/1998 Katz ..... A42B 3/00 2/425
5,790,988 A * 8/1998 Guadagnino, Jr. ..... A42B 3/00 2/425
6,272,692 B1 * 8/2001 Abraham ..... A42B 3/063 2/909
6,343,385 B1 * 2/2002 Katz ..... A42B 3/06 2/412
8,826,468 B2 * 9/2014 Harris ..... A42B 3/069 2/411
9,032,558 B2 * 5/2015 Leon ..... A42B 3/125 2/412
2006/0000009 A1 * 1/2006 Fleming ..... A42B 3/00 2/412
2006/0212998 A1 * 9/2006 Gath ..... A42B 3/30 2/423
2008/0080171 A1 * 4/2008 Lombard ..... A42B 3/044 362/106
2012/0260403 A1 * 10/2012 Hardy, III ..... A42B 3/16 2/244
2012/0278976 A1 * 11/2012 Benton ..... A42B 3/08 2/421
2014/0310856 A1 * 10/2014 Guadagnin ..... A42B 3/04 2/417
2015/0150330 A1 * 6/2015 Andrews ..... A42B 3/205 2/414
2015/0320134 A1 * 11/2015 Stolker ..... A42B 3/069 2/411
2016/0113346 A1 * 4/2016 Lowe ..... A42B 3/10 2/412
2019/0183203 A1 * 6/2019 Krynock ..... A42B 3/28
2019/0357622 A1 * 11/2019 Fontana ..... A42B 3/06

* cited by examiner

HELMET WITH EXTENDED PORTIONS CONFIGURED TO PROTECT SQUAMOUS TEMPORAL BONES OF A WEARER

CROSS REFERENCE TO RELATED APPLICATION

This application is a continuation-in-part of U.S. patent application Ser. No. 16/370,200, filed Mar. 29, 2019, entitled "Surfing Helmet: Recreational and Professional," the disclosure of which is hereby incorporated in its entirety by reference.

BACKGROUND

Technical Field

This disclosure is directed to a protective helmet, such as a helmet for surfing and/or other watersport activities, and, in particular, to a helmet that includes extension portions configured to protect squamous temporal bones of a wearer.

Technical Description

Surfing is a watersport of increasing popularity. Estimates suggest that, as of 2019, there may have been from about 5 million (Surf Industry Manufacturers Association) to about 23 million (International Surfing Association) surfers worldwide. As evidence of the growing popularity of the sport, surfing made its debut in the 2020 Summer Olympic Games in Tokyo, Japan, which occurred in July 2021. It is expected that, due to the exposure offered by the Olympic Games, surfing will continue to grow in popularity, especially among teenagers and young adults.

Head injuries are a leading cause of death and disability in the United States for individuals under 45 years of age. Head injuries are especially prevalent in sports or activities, such as surfing, where a participant may flip-over, fall backwards, roll, twist, and/or where the participant's head can be forced in a downward direction by external forces, such as by forces exerted on the participant by crashing waves. In order to reduce the incidence of head injuries in recreational sports, many participants wear protective headgear. Helmets for water sports (e.g., surfing, water skiing, wakeboarding, knee boarding, windsurfing, tubing, jet skiing, whitewater rafting, kayaking, rowing, and/or canoeing) are known and commercially available from various manufacturers including NeilPryde Ltd., Gath Sports, Pro-Tec, Tontron Sports Goods, NRS Watersport, and others.

Many of these commercially available helmets are hard helmets comprising rigid shells (sometimes referred to as hard-shell helmets) formed from plastics or other composite materials and interior padded portions or liners mounted to an inner surface of the shell. Examples of hard-shell helmets including rigid plastic shells and padded liners are described, for example, in U.S. Pat. No. 9,439,467, entitled "Accessory structures for connection between straps and related methods", and U.S. Pat. No. 9,474,318, entitled "Protective snow and ski helmet."

Other exemplary helmets (sometimes referred to as soft-shell helmets) that can be used for watersport activities do not include an exterior plastic shell. Instead, these soft-shell helmets include a foam body sized to fit over the wearer's head. The foam body can include a combination of ring portions and cross portions that form a frame-like structure that defines a cavity sized to tightly fit around the wearer's head. Examples of soft-shell or foam helmets are described, for example, in U.S. Pat. No. 4,612,672, entitled "Protective head gear" and U.S. Pat. No. 5,790,988, entitled "Protective headgear."

Head injuries are a relatively common risk of watersport activities, such as surfing. After a wipe-out, head injuries frequently occur when a surfer's board or someone else's board is propelled towards the surfer's head by force of the wave and/or by the natural buoyancy of the board. For example, the buoyancy of the surf board can keep the board at the water surface and can propel the board in an upward direction towards a surfer's head. According to a study of surfing injuries, surfing related head and scalp injuries are most often caused by the surfer's own board (55%), the ocean floor (18%), or someone else's board (11%). Amongst board related injuries, lacerations of the scalp account for 17% of all injuries. Many of these scalp related lacerations (about 41%) are caused by surfboard fins.

However, despite the fact that head injuries account for from about 20% to about 40% of all surfing injuries and are responsible for a significant proportion of fatalities, few surfers (only about 8% according to some surveys) wear protective headgear, such as hard-shell or soft-shell helmets. One reason for the limited use of helmets may be that surfers do not perceive the risk of head injury as being high. In fact, some surveys suggest that more than 50% of surfers feel that the benefit of wearing headgear is low. Further, while some surfers may appreciate that wearing a helmet could prevent surfing related head trauma, they choose not to wear a helmet because they do not consider current helmet designs to be aesthetically pleasing or "cool." Surfers may also believe that current helmet designs are restrictive or uncomfortable impeding athletic performance. Further, the present inventor believes that many surfers are "minimalists" believing that "less is more," when selecting safety equipment. The helmet designs of the present disclosure are intended to be more appealing for surfers and other water sport enthusiasts, while providing robust protection for head trauma which can occur during surfing. In particular, the helmet designs for the present disclosure are intended to include both rigid materials covering portions of the head that are especially susceptible to head trauma, while also providing a minimalist aesthetic that is pleasing to surfers and other watersport participants. Accordingly, the present inventor believes that the helmet designs of the present disclosure will be accepted by surfers and other athletes, leading to more widespread use of helmets by watersport athletes and recreational participants.

SUMMARY

According to an aspect of the disclosure, a helmet includes a frame having a plurality of tubular segments arranged to form a plurality of enclosed spaces. The frame includes a cap portion and at least one extension portion. The cap portion defines an interior sized to fit over a head of a wearer. The cap portion includes a plurality of main tubular segments extending from a front of the helmet, configured to be positioned over a forehead of the wearer, to a back of the helmet, configured to be positioned over an occipital region of the wearer's head, and at least one tubular cross segment extending between the main segments. The at least one extension portion includes extending tubular segments that extend from a lower edge of the cap portion to a common point that is configured to be positioned below the wearer's ear. The extending tubular segments and the lower edge of the cap portion are configured to define a space sized to be positioned over the wearer's ear and squamous temporal bones of the wearer's head. The helmet also includes at least one perforated cover plate mounted to the extending tubular segments of the extension portion. The at least one cover plate is configured to cover the wearer's ear and at least a portion of the squamous temporal bones of the wearer's head.

According to another aspect of the disclosure, a method for reducing or preventing skull injury includes a step of covering a human skull with right perforated ear protection that reduces or prevents the right perforated ear protection from contacting or impacting all of or a portion of a squamous right temporal bone. The method further includes a step of covering the human skull with left perforated ear protection that reduces or prevents the left perforated ear protection from contacting or impacting all of or a portion of a squamous left temporal bone. The method further includes connecting the right perforated ear protection and the left perforated ear protection to a helmet for supporting the right perforated ear protection above or in close proximity to the all of or the portion of the squamous right temporal bone and for supporting the left perforated ear protection above or in close proximity to the all of or the portion of the squamous left temporal bone. The method further includes forming a peaked forehead for the helmet.

According to another aspect of the disclosure, a helmet includes: right perforated ear protection configured from contacting or impacting all of or a portion of a squamous right temporal bone; and left perforated ear protection configured from contacting or impacting all of or a portion of a squamous left temporal bone. The right perforated ear protection and the left perforated ear protection are connected to the helmet, which includes a peaked forehead.

According to another aspect of the disclosure, a method of making a means for reducing or preventing skull injury includes assembling: a means for reducing or preventing contact or impact of all of or a portion of a squamous right temporal bone; a means for reducing or preventing contact or impact of all of or a portion of a squamous left temporal bone; at least one means for ear protection; a means for scalp protection; a peaked means for forehead protection; a means for orbit protection; a means for mounting a camera; a means for electroluminescence; a means for power supply; a means for supporting the power supply; and a means for contact with a human chin.

According to another aspect of the disclosure, a method includes covering a human skull above all of or a first portion of a squamous temporal bone, the method includes covering the human skull with a first layer of material that reduces or prevents the first layer of material from contacting or impacting all of or a first portion of the squamous temporal bone. The first layer of material may be connected to a device or apparatus for supporting the first layer of material above or in close proximity to the all of or the first portion of the squamous temporal bone. Additionally, the method may include comprising covering the human skull above all of or a second portion of a squamous temporal bone.

According to another aspect of the disclosure, a method includes covering the human skull with a second layer of material that reduces or prevents the second layer of material from contacting or impacting all of or the second portion of the squamous temporal bone. The second layer of material may be connected to the device or apparatus for supporting the second layer of material above or in close proximity to the all of or the second portion of the squamous temporal bone. The first layer of material and the second layer of material may form a single layer of material. In addition, any of or all of the following may be provided: a chin strap, ear protection, a perforated cover, scalp protection, cross member struts, forehead protection, orbit protection, a peaked forehead design, an integrated camera mount, an integrated electroluminescent wire channel, a power supply mount, and an electroluminescent wire.

According to another aspect of the disclosure, a device or apparatus includes a first layer of material that reduces or prevents the first layer of material from contacting or impacting all of or a first portion of the squamous temporal bone, a second layer of material that reduces or prevents the second layer of material from contacting or impacting all of or the second portion of the squamous temporal bone, and the first and second layers of material connected to the device or apparatus. The device or apparatus may also include providing any of or all of: a chin strap, ear protection, a perforated cover, scalp protection, cross member struts, forehead protection, orbit protection, a peaked forehead design, an integrated camera mount, an integrated electroluminescent wire channel, a power supply mount, and an electroluminescent wire.

According to another aspect of the disclosure, a method of making a means for reducing or preventing skull injury includes assembling a means for reducing or preventing contact or impact of all of or a first portion of a squamous temporal bone, a means for reducing or preventing contact or impact of all of or a second portion of a squamous temporal bone, at least one means for ear protection, a means for scalp protection, a means for forehead protection, a means for orbit protection, a means for mounting a camera, a means for electroluminescence, a means for power supply, a means for supporting the power supply, and a means for contact with a human chin.

Further non-limiting examples are set forth in the following numbered clauses.

Clause 1: A helmet comprising: a frame comprising a plurality of tubular segments arranged to form a plurality of enclosed spaces, the frame comprising: a cap portion defining an interior sized to fit over a head of a wearer, the cap portion comprising a plurality of main tubular segments extending from a front of the helmet, configured to be positioned over a forehead of the wearer, to a back of the helmet, configured to be positioned over an occipital region of the wearer's head, and at least one tubular cross segment extending between the main segments; and at least one extension portion comprising extending tubular segments that extend from a lower edge of the cap portion to a common point that is configured to be positioned below the wearer's ear, wherein the extending tubular segments and the lower edge of the cap portion are configured to define a space sized to be positioned over the wearer's ear and at least a portion of the squamous temporal bones of the wearer's head; and at least one perforated cover plate mounted to the extending tubular segments of the extension portion, the at least one cover plate being configured to cover the wearer's ear and squamous temporal bones of the wearer's head.

Clause 2: The helmet of clause 1, wherein the helmet comprises a surfing helmet.

Clause 3: The helmet of clause 1 or clause 2, wherein the frame comprises a molded frame in which the plurality of tubular segments are integrally formed.

Clause 4: The helmet of clause 1 or clause 2, wherein the plurality of tubular segments of the frame are connected together by adhesives, fasteners, and/or welding processes.

Clause 5: The helmet of any of clauses 1-4, wherein the plurality of tubular segments comprise a rigid plastic, such as high density polyethylene, or composite carbon fiber material.

Clause 6: The helmet of any of clauses 1-4, wherein the plurality of tubular segments are hollow.

Clause 7: The helmet of any of clauses 1-6, wherein the main segments comprise a center segment that extends from the front of the helmet to the back of the helmet over a crown-point or vertex of the wearer's skull, and a plurality of branched ribs that extend from a front portion of the center segment to a rear portion of the center segment curving about the crown point or vertex of the wearer's head.

Clause 8: The helmet of clause 7, wherein the center segment defines a raised ridge that protrudes outwardly relative to the branched ribs, the raised ridge extending from the front of the helmet to the back of the helmet over the crown point or vertex of the wearer's head.

Clause 9: The helmet of any of clauses 1-8, wherein the at least one cover plate is mounted to the extending segments of the at least one extension portion, such that an inner surface of the at least one cover plate is spaced apart from an inner side of the extending tubular segments by a distance of at least 10.0 mm.

Clause 10: The helmet of clause 9, wherein the extending segments are positioned such that, when the helmet is on the wearer's head, the inner side of the at least one cover plate is configured to be spaced apart from the squamous temporal bones of the wearer's head by a distance of at least 10.0 mm.

Clause 11: The helmet of any of clauses 1-10, wherein the at least one cover plate comprise a rigid plastic sheet, such as a high density polyethylene sheet, and a plurality of openings extending through the rigid plastic sheet.

Clause 12: The helmet of any of clauses 1-11, wherein the cap portion comprises a peaked forehead portion on the front of the helmet that provides forehead/orbital protection, the peaked forehead portion formed from at least one main segment having a front end that is configured to extend beyond the wearer's forehead by a distance of at least 2.5 cm, when the helmet is worn on the wearer's head.

Clause 13: The helmet of clause 12, further comprising a liner connected to one or more of the plurality of segments of the frame and spaced apart from the peaked forehead portion of the frame by a distance of at least 2.0 cm.

Clause 14: The helmet of any of clauses 1-13, wherein the cap portion of the helmet is free from exterior shells, and wherein the frame is configured such that water passes through the enclosed spaces defined by the plurality of tubular segments.

Clause 15: The helmet of any of clauses 1-14, further comprising interior padding connected to and extending from an inner side of the plurality of tubular segments, the interior padding defining an interior cavity sized to receive at least a portion of the wearer's head.

Clause 16: The helmet of any of clauses 1-15, further comprising a plurality of inflatable cushions mounted to an inner side of the plurality of tubular segments of the frame.

Clause 17: The helmet of clause 16, further comprising a nozzle for inflating the plurality of inflatable cushions, and a plurality of conduits mounted to segments of the frame fluidly connecting the inflatable cushions together for passing fluid from the nozzle to the plurality of inflatable cushions.

Clause 18: The helmet of clause 17, wherein the plurality of inflatable cushions comprise a top cushion configured to contact parietal region of the wearer's head, right and left cushions configured to contact temporal regions of the wearer's head, a front cushion configured to contact a frontal region of the wearer's head, and a rear cushion configured to contact the occipital region of the wearer's head.

Clause 19: The helmet of any of clauses 1-18, further comprising a mounting bracket connected to one or more of the plurality of tubular segments.

Clause 20: The helmet of clause 19, further comprising a camera support removably connected to the mounting bracket.

Clause 21: The helmet of any of clauses 1-20, wherein the at least one extension portion comprises a first extension portion configured to be positioned over the wearer's right ear and a second extension portion configured to be positioned over the wearer's left ear, the helmet further comprising a chin strap mounted between the first extension portion and the second extension portion configured to secure the helmet to the wearer's head.

Clause 22: The helmet of clause 21, wherein the chin strap extends between an inner side of one of the extending segments of the first extension portion and an inner side of one of the extending segments of the second extension portion.

Clause 23: The helmet of clause 22, wherein the chin strap is connected to the inner side of the extending segments by at least one of a snap, a fastener, or a screw.

Clause 24: The helmet of any of clauses 21-23, wherein the chin strap comprises a pocket configured to be secured to the wearer's chin.

Clause 25: The helmet of any of clauses 1-24, further comprising electroluminescent wires connected to and extending along the plurality of segments, and a power source mounted to the frame of the helmet electrically connected to the electroluminescent wires for providing electrical current to cause the wires to luminesce.

Clause 26: The helmet of clause 25, wherein the electroluminescent wires are mounted in grooves extending through the plurality of tubular segments of the frame.

Clause 27: The helmet of clause 25 or clause 26, wherein the power source comprises rigid plastic housing mounted to tubular segments of the cap portion.

Clause 28: The helmet of clause 27, wherein the power source is battery powered, and wherein the rigid plastic housing is sized to enclose one or more AA batteries.

Clause 29: A method for reducing or preventing skull injury, the method comprising: covering a human skull with right perforated ear protection that reduces or prevents the right perforated ear protection from contacting or impacting all of or a portion of a squamous right temporal bone; covering the human skull with left perforated ear protection that reduces or prevents the left perforated ear protection from contacting or impacting all of or a portion of a squamous left temporal bone; connecting the right perforated ear protection and the left perforated ear protection to a helmet for supporting the right perforated ear protection above or in close proximity to the all of or the portion of the squamous right temporal bone and for supporting the left perforated ear protection above or in close proximity to the all of or the portion of the squamous left temporal bone; and forming a peaked forehead for the helmet.

Clause 30: The method of clause 29, further comprising the right perforated ear protection and the left perforated ear protection forming a single layer of material.

Clause 31: A helmet comprising: right perforated ear protection configured from contacting or impacting all of or a portion of a squamous right temporal bone; left perforated ear protection configured from contacting or impacting all of or a portion of a squamous left temporal bone; and the right perforated ear protection and the left perforated ear protection connected to the helmet, the helmet having a peaked forehead.

Clause 32: The helmet of clause 31, further comprising: a chin strap.

Clause 33: The helmet of clause 31 or clause 32, further comprising scalp protection.

Clause 34: The helmet of any of clauses 31-33, further comprising cross member struts.

Clause 35: The helmet of any of clauses 31-34, further comprising orbit protection.

Clause 36: The helmet of any of clauses 31-35, further comprising an integrated camera mount.

Clause 37: The helmet of any of clauses 31-36, further comprising an electroluminescent wire channel.

Clause 38: The helmet of any of clauses 31-37, further comprising a power supply mount.

Clause 39: The helmet of any of clauses 31-38, further comprising an electroluminescent wire.

Clause 40: A method of making a means for reducing or preventing skull injury, the method comprising assembling: a means for reducing or preventing contact or impact of all of or a portion of a squamous right temporal bone; a means for reducing or preventing contact or impact of all of or a portion of a squamous left temporal bone; at least one means for ear protection; a means for scalp protection; a peaked means for forehead protection; a means for orbit protection; a means for mounting a camera; a means for electroluminescence; a means for power supply; a means for supporting the power supply; a means for contact with a human chin; a means for supporting on or in close proximity to a human skull; a means for supporting all or some of the above means; and wherein at least one means substitutes or functions for at least one other means.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. As used in the specification and the claims, the singular form of "a", "an", and "the" include plural referents unless the context clearly dictates otherwise.

DETAILED DESCRIPTION

Figure 2:
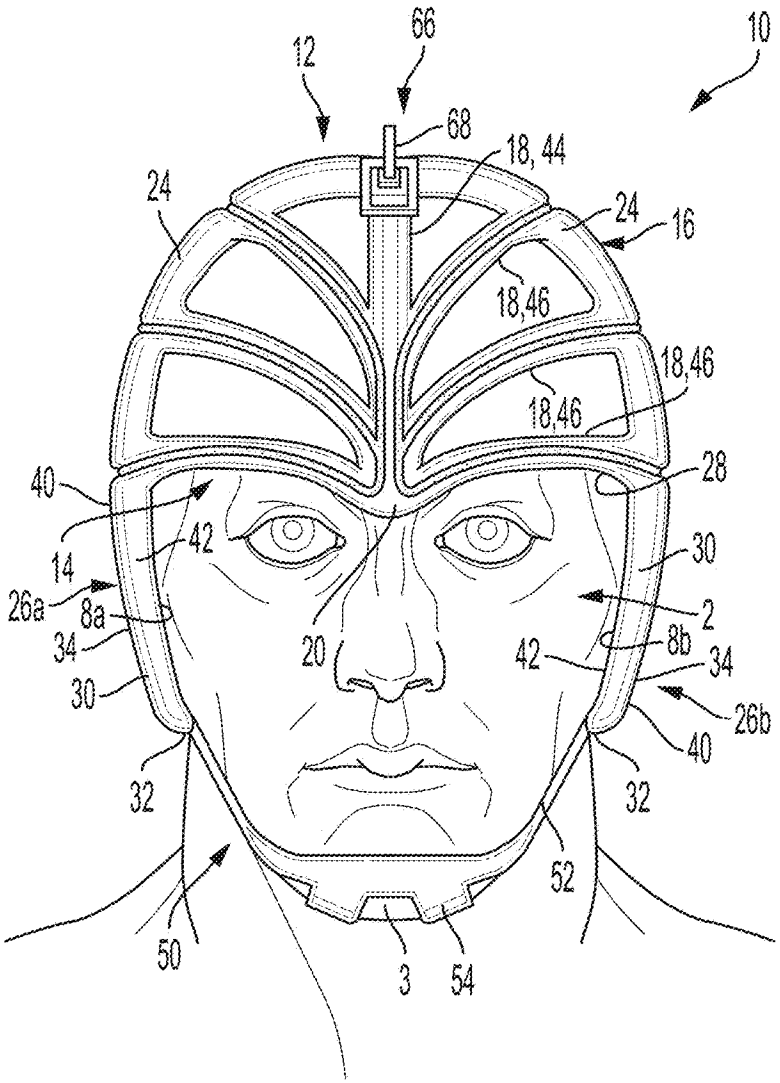
FIG. 2 is a front view of the helmet and wearer of FIG. 1.

For purposes of the description hereinafter, the terms "upper", "lower", "right", "left", "vertical", "horizontal", "top", "bottom", "lateral", "longitudinal," and derivatives thereof shall relate to the disclosure as it is oriented in the drawing figures. However, it is to be understood that the disclosure may assume various alternative variations, except where expressly specified to the contrary. It is also to be understood that the specific devices illustrated in the attached drawings, and described in the following specification, are simply exemplary embodiments of the disclosure. Hence, specific dimensions and other physical characteristics related to the embodiments disclosed herein are not to be considered as limiting.

For the purposes of this specification, unless otherwise indicated, all numbers expressing dimensions, physical characteristics, and so forth used in the specification and claims are to be understood as being modified in all instances by the term "about." Unless indicated to the contrary, the numerical parameters set forth in the following specification and attached claims are approximations that can vary depending upon the desired properties sought to be obtained by the present invention.

Notwithstanding that the numerical ranges and parameters setting forth the broad scope of the invention are approximations, the numerical values set forth in the specific examples are reported as precisely as possible. Any measured numerical value, however, may inherently contain certain errors resulting from the standard deviation found in their respective testing measurements.

Also, it should be understood that any numerical range recited herein is intended to include all sub-ranges subsumed therein. For example, a range of "1 to 10" is intended to include any and all sub-ranges between and including the recited minimum value of 1 and the recited maximum value of 10, that is, all subranges beginning with a minimum value equal to or greater than 1 and ending with a maximum value equal to or less than 10, and all subranges in between, e.g., 1 to 6.3, or 5.5 to 10, or 2.7 to 6.1.

Figure 6:
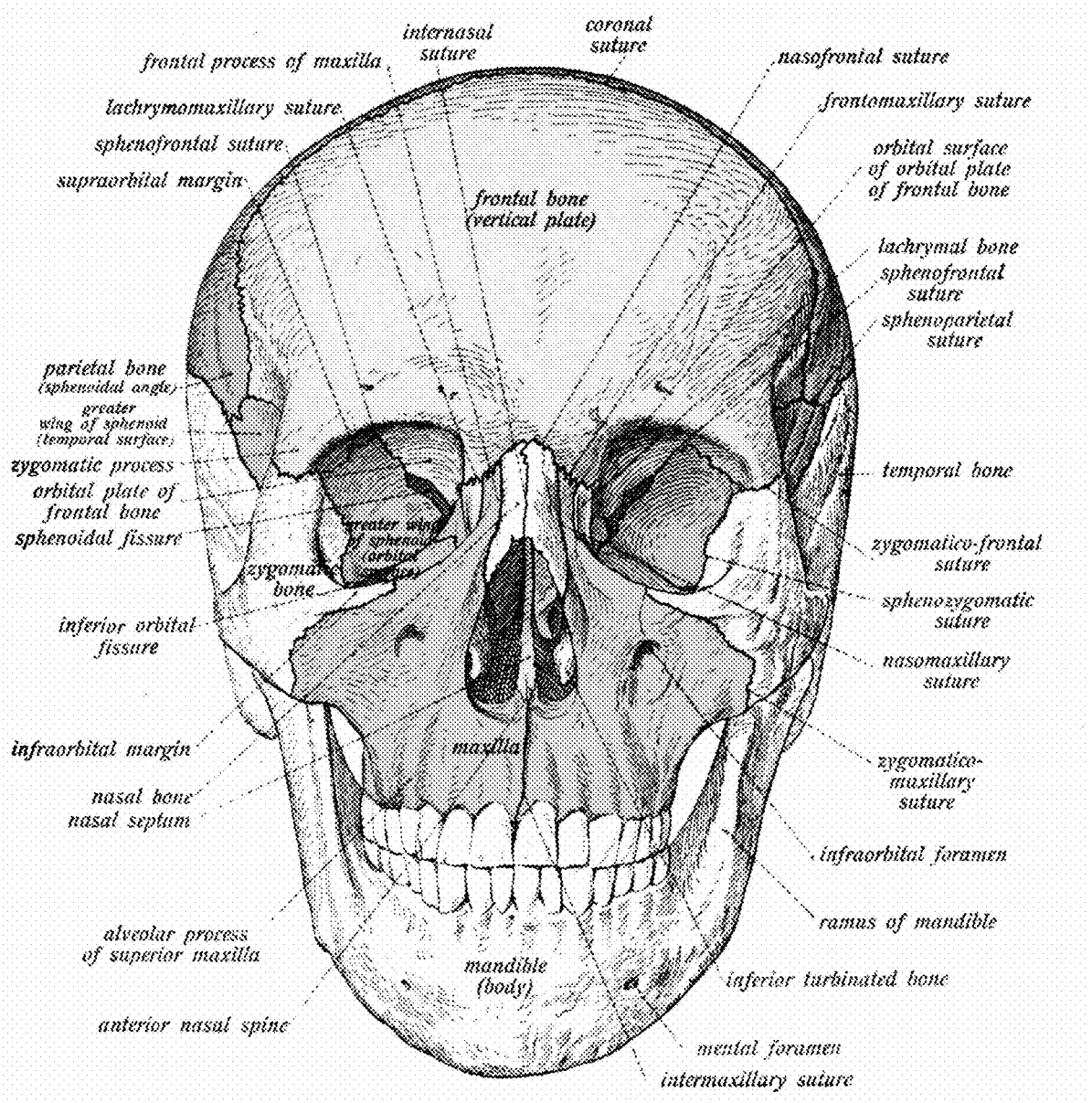
FIGS. 6 and 7 are schematic drawings showing human skull anatomy.
Figure 7:
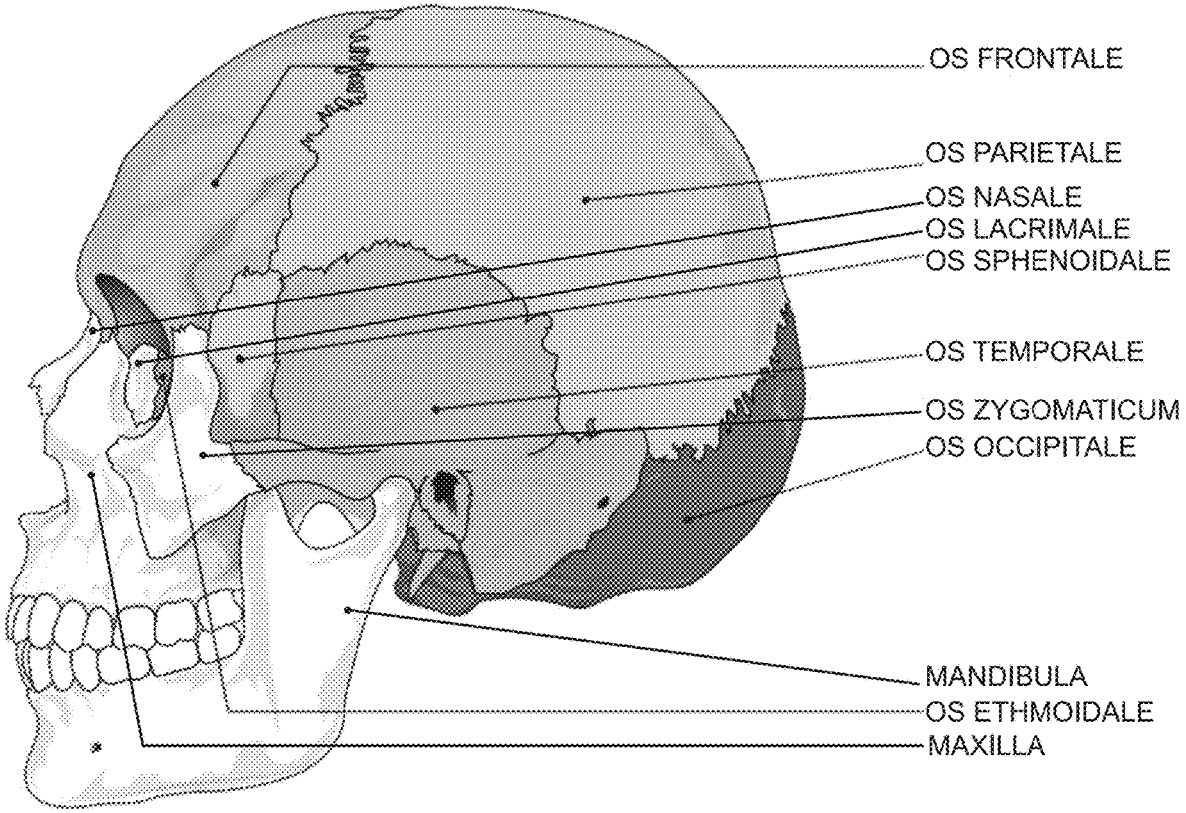
Figure 8:
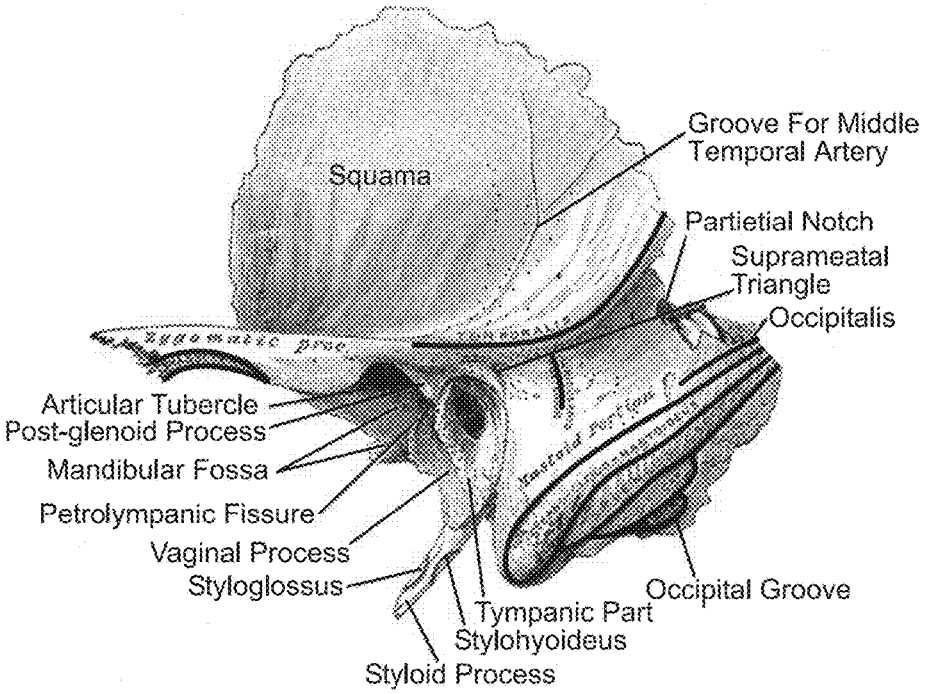
FIG. 8 is a schematic drawing of a portion of a human skull including the left temporal bone.

With reference to the figures, the present disclosure is directed to helmets 10, 110, 210 and methods for protecting a wearer's head and/or skull to prevent or reduce a risk of skull injury. The present inventor believes that currently available helmets used for watersports do not provide sufficient coverage and protection for all regions of the wearer's head. In particular, the present inventor believes that currently available helmets do not provide sufficient protection for squamous temporal bones, which are the thinnest part of the skull. FIGS. 6-8 show human skull anatomy. In particular, FIG. 8 shows human skull anatomy, including the left temporal bone. As shown in FIG. 8, the squamous temporal bones are located just above and in front of the ears. These squamous temporal bones can be from 1 mm to 3 mm thick under the temporalis muscle. It is believed that these thin bones are especially likely to fracture when exposed to small surface area, high force impacts, such as impact forces that occur when an edge of a surfboard contacts the temporalis region of the wearer's head with significant force. When the squamous temporal bones are fractured, bone pieces can lacerate vascular structures, particularly the middle meningeal artery or vein.

These laceration of vascular structures can produce a fatal epidural hematoma as follows. An individual can suffer an initial trauma, where, for example, an edge or fin of a surfboard hits the surfer in the side of the head (e.g., in the temporalis region proximate to the individual's ear). The initial trauma can cause a concussion, episodes of disorientation, or brief loss of consciousness. Following the brief episode of disorientation or loss of consciousness, the individual may have a lucid interval, in which the individual appears to have recovered from the initial trauma. However, during this lucid interval, epidural blood can accumulate in proximity to the lacerated vein or artery, which can lead to drowsiness, coma, and death when unrecognized and/or untreated. The present inventor has cared for several patients who suffered from epidural hematoma caused by fractures of the squamous temporal bones and has observed this progression from initial trauma to epidural hematoma. In view of these observations, the helmets 10, 110, 210 of the present disclosure are designed to provide protection to prevent such injuries while also being comfortable, aesthetically pleasing, and sufficiently "minimalist" to avoid obstructing a wearer's field of view or restricting athletic performance.

More specifically, the present disclosure is directed to helmets 10, 110, 210 designed to improve wearer safety by reducing risks of concussions, skull fractures, and other traumatic brain injuries, including the previously described epidural hematoma caused by fractures of the squamous temporal bones. As described in detail herein, the helmets 10, 110, 210 comprise structures, such as a frame 12, formed from interconnected tubular segments, in combination with inflated bladders, cushions, pads, and/or pillows for absorbing and/or distributing impact forces, such as forces caused by impacts with objects and/or other individuals, wipe-outs, crashes, and similar traumatic events, which can occur during water sports and related activities.

The helmets 10, 110, 210 of the present disclosure are designed to be worn while participating in water sports and water activities including, without limitation, surfing, water skiing, wakeboarding, knee boarding, windsurfing, tubing, jet skiing, boating, rowing, whitewater rafting, canoeing, and/or kayaking. The helmets 10, 110, 210 of the present disclosure can also be used for any non-water sport or activity in which a lightweight, comfortable helmet that provides protection from impact forces is required, including, without limitation, participation in contact sports (i.e., hockey, lacrosse, baseball (e.g., batting helmets), rugby, martial arts, or boxing), vehicle racing (e.g., motorcycle, automobile, snowmobile, and/or bicycle racing), skiing, snowboarding, ice skating, inline skating, roller skating, skateboarding, or similar activities.

In some examples, the helmets 10, 110, 210 of the present disclosure incorporate an open, front to back rib construction with interposed cross-members to provide additional rigidity and protection from impacts. Beneficially, in some examples, the present inventor believes that this open format design of the present helmets 10, 110, 210 allows water to flow through the helmet preventing drag or the effect of "water braking" that is seen with, for example, helmets with rigid shells and fewer openings or spaces between portions of the shell.

Figure 3:
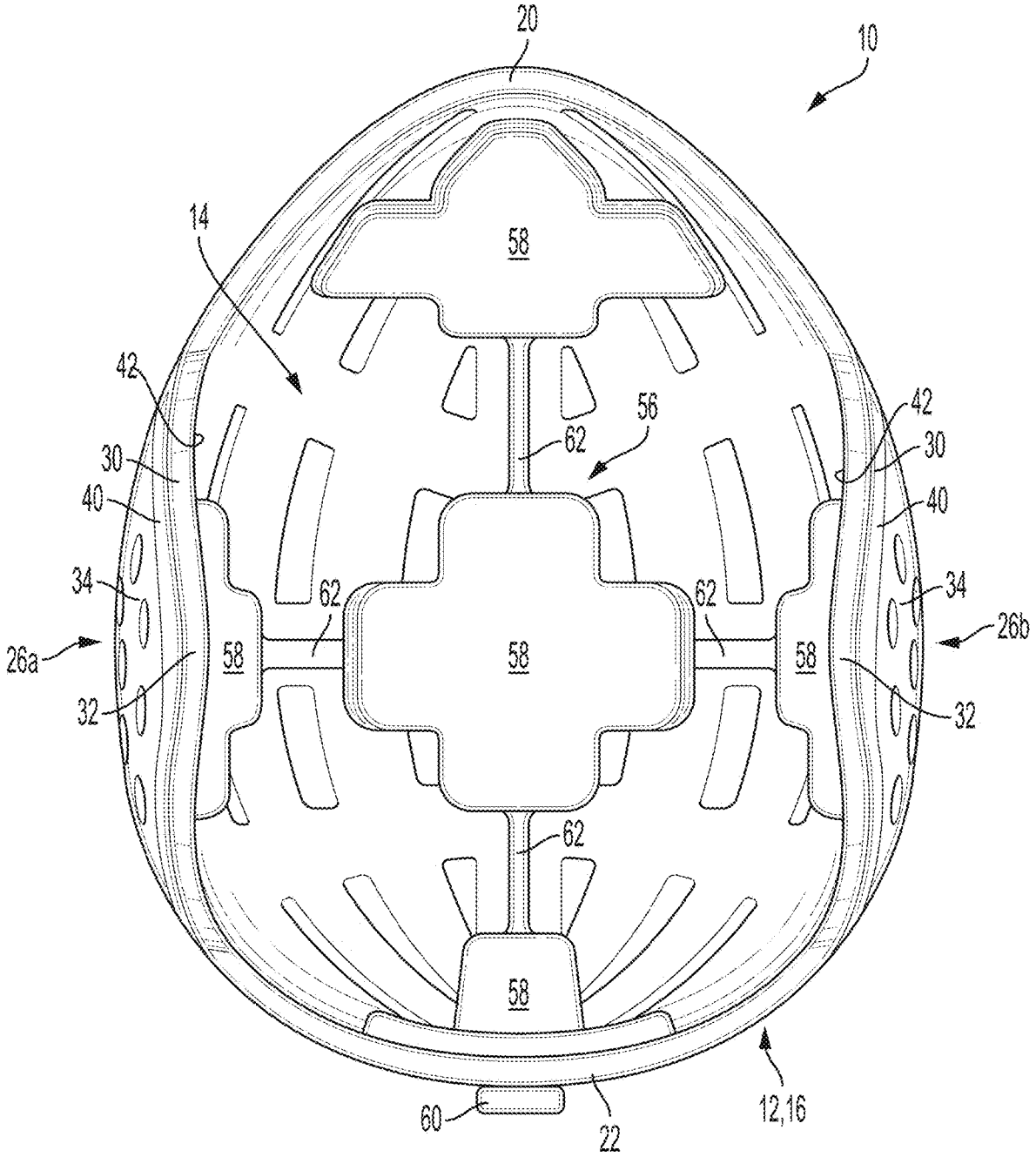
FIG. 3 is a bottom view of the helmet of FIG. 1.
Figure 5:
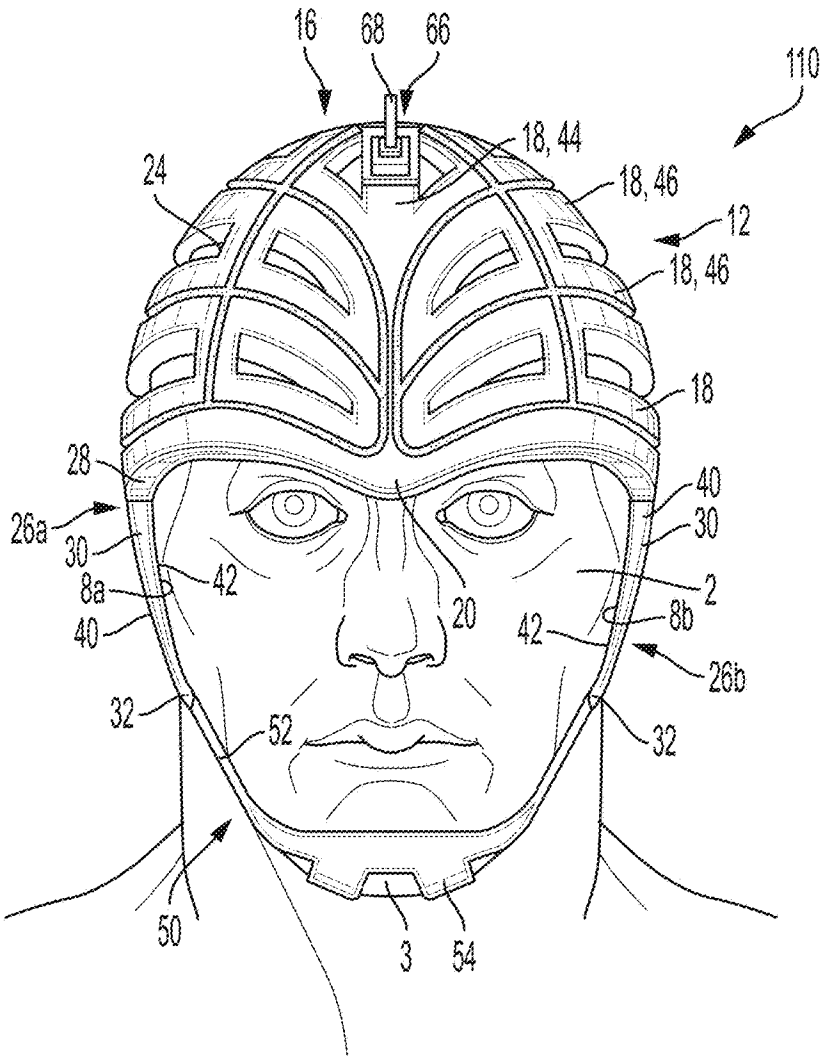
FIG. 5 is a front view of the helmet and wearer of FIG. 4.
Figure 4:
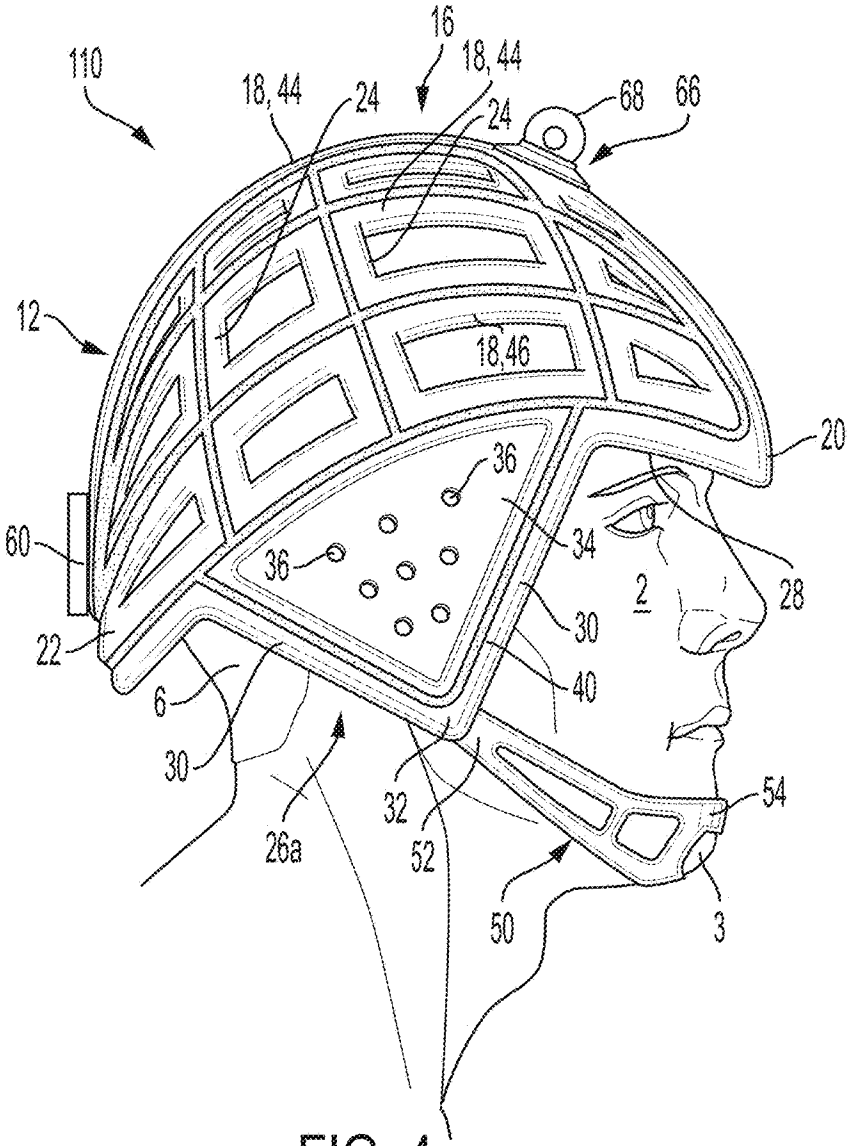
FIG. 4 is a side view of another example of a helmet configured to protect at least portions of a wearer's squamous temporal bones, according to an aspect of the present disclosure.

The helmet 10, 210 of the present disclosure can be a recreational surfing helmet (shown in FIGS. 1-3 and 9-16) or a professional surfing helmet 110 (shown in FIGS. 4 and 5). In some examples, the different exemplary helmets (i.e., recreational and professional) can have the same design, configuration, and/or appearance, and can differ only in materials used to form different features of the helmet 10, 110, 210. For example, the recreational helmet 10, 210 can be constructed using a low-cost rigid plastic material, such as clear or colored high-density polyethylene plastic. The professional surfing helmet 110 can be constructed of a strong, lightweight composite material, such as carbon fiber composites and/or titanium metal alloys.

With reference to FIGS. 1, 2, 4, and 5, in some examples, the helmet 10, 110 comprises the frame 12, which comprises a plurality of interconnected tubular segments 18, 24 arranged to form a plurality of cells or spaces. As used herein, the "frame" refers to a network or lattice of interconnected struts, segments, slats, or other members that are arranged to form or define an interior space or cavity 14 that is sized to fit over a head 2 of a wearer. The "frame" differs from, for example, a shell, which is formed from a molded or bent sheet, such as a sheet of rigid plastic material molded into a helmet shape. While the rigid sheet can include air vents or slots, the helmet formed from the rigid shell substantially encloses the wearer's head. In contrast, the helmets 10, 110 of the present disclosure have a relatively open configuration. Due to this open configuration of the plurality of segments 18, 24, the helmet 10 of the present disclosure is desirably lighter, less restrictive, and more "minimalist" compared to conventional hard-shell helmet designs.

The frame 12 of the helmet 10, 110 can comprise a cap portion 16, which defines the interior space or cavity 14 sized to fit over the wearer's head 2. The cap portion 16 can comprise a plurality of primary or main tubular segments 18 arranged front to back, meaning that the primary or main segments 18 extend from a front 20 of the helmet 10, which is positioned over a forehead 4 of the wearer's head 2, to a back 22 of the helmet 10, which is positioned over an occipital region 6 of the wearer's head 2. The cap portion 16 of the frame 12 can also comprise tubular cross segments 24 extending between the main 18 segments. For example, as shown in FIGS. 1, 2, 4, and 5, the helmets 10, 110 can include two cross segments 24, which extend between each of the main or primary segments 18. In other examples, the helmets 10, 110 can comprise one or more partial cross segments 24 that extend between only a few of the main segments 18. For example, cross segments 24 can extend between two adjacent main or primary segments 18, but can be offset from other cross segments 24. The lattice or network of the main segments 18 and cross segments 24 is configured to provide both structural rigidity for the helmet 10, 110 and protection for the wearer's scalp and skull. In particular, the segments 18, 24 can be configured to provide protection from lacerations, such as lacerations caused by, for example, surf board edges/fins, other surfing equipment, and/or from impacts with the ocean floor.

In some examples, the helmets 10, 110 also include extension portions, such as a left extension portion **26*a* and a right extension portion 26*b*, that extend from a lower edge 28 of the cap portion 16 over the wearer's ears 8*a*, 8*b* and over at least a portion of the squamous temporal bones of the wearer's skull. As previously described, and as shown in the anatomical drawings in FIGS. 6-8, the squamous temporal bones are located just above and in front of the ears 8***a*, 8*b*. For example, the frame 12 can include a first or right extension portion 26*a* sized to extend over the wearer's right ear 8*a* and a second or left extension portion 26*b* sized to extend over the wearer's left ear 8*b*. The first extension portion 26*a* and/or the second extension portion 26*b* can comprise tubular segments, referred to herein as extension segments 30, that extend from the lower edge 28 of the cap portion 16 to a common point 32 positioned below the right ear 8*a* or the left ear 8*b* of the wearer's head 2. The extension segments 30 and the lower edge 28 of the cap portion 16 define a space sized to be positioned over the wearer's ear 8*a*, 8*b* and at least a portion of the squamous temporal bones of the wearer's head 2. For example, the extension segments 30 can be angled segments that extend from the lower edge 28 of the cap portion 16. In such instances, the space defined by the extension segments and edge can be a substantially triangular shape, as shown in FIGS. 1 and 4.

The helmets 10, 110 further comprise cover plates 34 that are mounted to the extension segments 30 and/or lower edges 28 of the cap portion 16. The cover plates 34 comprise rigid plastic sheets, such as high density polyethylene sheets. The cover plates 34 can be perforated and/or can comprise or define a plurality of openings 36 or through-holes extending through the rigid sheets. In some examples, the cover plates 34 can be formed from rigid plastic sheets that are from about 1 mm to about 10 mm thick, or from about 2 mm to about 6 mm thick, or, preferably, about 4 mm thick.

Figure 1:
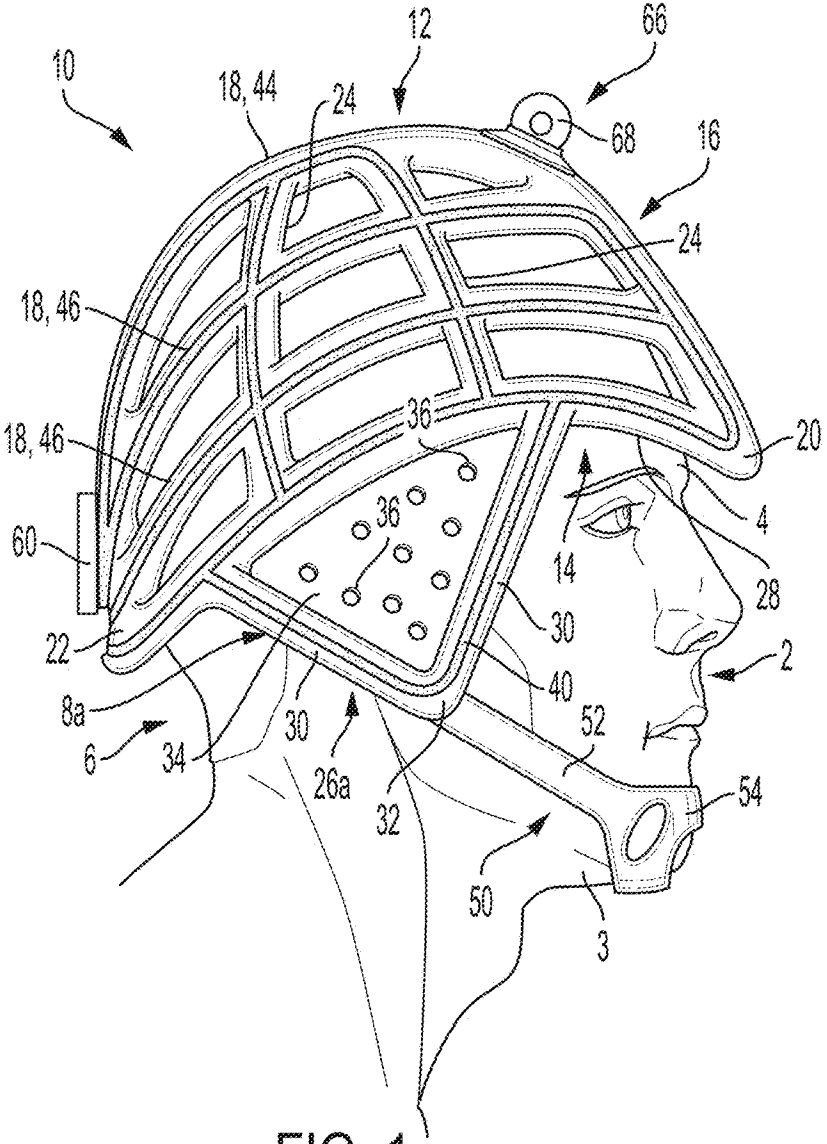
FIG. 1 is a side view of a helmet configured to protect at least portions of the squamous temporal bones of the wearer, according to an example of the present disclosure.

As shown in FIGS. 1 and 4, the cover plates 34 are positioned over the spaces defined by the extension portions 30 and lower edges 28 of the frame 12, thereby covering and protecting the squamous temporal bones of the wearer from fracture or injury. The extension portions 26*a*, 26*b* and cover plates 34 can also protect the wearer's ears 8*a*, 8*b* from wind and sun (i.e., solar radiation) exposure. Protecting the ears 8*a*, 8*b* and other portions of the wearer's skin from wind and sun exposure prevents wind or sun burns, thereby providing protection from different skin cancers (e.g., basal cell carcinoma, squamous cell carcinoma, and/or melanoma). Basal cell carcinoma is a low grade malignancy due to chronic exposure to solar radiation and is the most common solar radiation induced skin cancer in surfers. Melanoma is a high grade malignancy related to solar radiation exposure and is less common. Both kinds of skin cancer can be prevented by limiting or reducing exposure to solar radiation and/or by consistently applying waterproof sunscreen to uncovered areas of the wearer's skin to protect the skin from solar radiation exposure. Protecting the ears 8*a*, 8*b* from wind can also prevent or reduce occurrences of surfer's ear. Surfer's ear is a common condition of the external ear canal for avid surfers that results from chronic and/or prolonged wind and cold exposure. This exposure to wind/cold results in bony exostoses (i.e., a bony overgrowth in the ear canal), which can fully or partially close the external canal producing conductive hearing loss and otitis media.

The extension portions 26*a*, 26*b* can be positioned so that the cover plates 34 are separated or spaced apart from the squamous temporal bones of the wearer's skull to reduce risk of injury, which may occur if inner surfaces of the cover plates 34 were tightly pressed against the wearer's temporalis region by, for example, external impact forces. For example, the cover plates 34 can be mounted or connected to an outer side 40 of the extension segments 30, meaning that the inner surfaces of the cover plates 34 are spaced apart from inner sides 42 (shown in FIG. 2) of the extension segments 30 by a distance of from 10.0 mm to 20.0 mm, or from 12.5 mm to 17.4 mm, or at least about 10.0 mm. Further, when the helmet 10, 110 is being worn, the inner surfaces 38 of the cover plates 34 can be spaced apart from the wearer's skin (i.e., portions of the skin covering the temporalis muscles and squamous temporal bones) by a distance of at least about 10.0 mm.

In some examples, the tubular segments 18, 24, 30 that make up the frame 12 can be hollow tubular structures. Desirably, the hollow tubular segments 18, 24, 30 are formed from materials that are sufficiently rigid to provide suitable protection for the wearer's head 2, without restricting the wearer's range of movement or limiting the wearer's field of view. By using hollow tubular segments 18, 24, 30, the helmet frame 10 can also be buoyant, assisting the surfer to keep his or her head above water after, for example, falling off a surfboard. Also, as previously discussed, the open arrangement of the tubular segments 18, 24, 30 allows water to pass through the helmet 10 avoiding the drag or waterbraking effect that can occur with other helmet designs. While described herein as "tubular segments" it is understood that the segments 18, 24, 30 can have a variety of hollow and non-hollow shapes and cross-sections within the scope of the present disclosure. For example, the segments 18, 24, 30 can be hollow tubes having a cylindrical outer surface, a cylindrical inner surface, and an interior lumen enclosed by the cylindrical inner surface. In other examples, the segments 18, 24, 30 can have a variety of other cross-sectional shapes, such as an oval, semi-circle, square, rectangle, trapezoid, or other regular or irregular shapes. In one example, the segments 18, 24, 30 are elongated slats that are wide and relatively thin. As previously indicated, the segments 18, 24, 30 can be hollow or solid (i.e. non-hollow).

In some examples, hollow tubular segments 18, 24, 30 of the frame 12 can be formed from rigid plastic materials, such as high-density polyethylene, polycarbonate, acrylics, or other rigid plastic materials, as are known in the art. The rigid plastic materials can be transparent or translucent, making the helmet 10, 110 less noticeable and/or less of a distraction for the wearer. For professional helmets (as shown in FIGS. 4 and 5), some or all of the segments 18, 24, 30 can comprise a high-strength lightweight engineered material, such as titanium alloy and/or carbon fiber materials. When the tubular segments 18, 24, 30 are formed from high-strength lightweight engineered materials, such as titanium alloy and/or carbon fiber materials, the segments 18, 24, 40 may not need to be hollow. Instead, tubular segments 18, 24, 30 formed from such engineered materials may be sufficiently buoyant for use in watersport helmets, even when the tubular segments 18, 24, 30 formed from high-strength lightweight engineered materials are solid or non-hollow.

In some examples, the frame 12 can be formed by a plastic molding process, as is known in the art, producing a molded structure in which some or all of the plurality of tubular segments 18, 24, 30 are integrally formed. For example, the frame 12 can be produced by an injection molding process, in which a fluid polymer precursor material is injected into a mold and cured to form the molded structure. In other examples, the tubular segments 18, 24, 30 can be separately molded or extruded members that are connected together by adhesives, fasteners, and/or welding processes, as are known in the manufacturing art, to form the frame 12.

The network or lattice of interconnected primary or main segments 18 and cross segments 24 of the cap portion 16 can be provided in a variety of arrangements or configurations within the scope of the present disclosure. In some examples, the primary or main segments 18 of the frame 12 comprise a center segment 44 that extends from the front 20 of the helmet 10 to the back 22 of the helmet 10 over a crown-point or vertex of wearer's skull. The primary or main segments 18 of the frame 12 further comprise a plurality of branched segments or ribs 46 that extend from a front portion of the center segment 44 to a rear portion of the center segment 44 curving about the crown-point or vertex of the wearer's head 2. In some examples, the center segment 44 defines a raised ridge or fin, which protrudes outwardly relative to other segments 18, 24, 30 of the frame 12.

With reference again to FIGS. 1, 2, 4, and 5, the helmet 10, 110 further comprises a chin strap 50 configured to secure the helmet 10, 110 to the wearer's head 2. The chin strap 50 can extend between the inner side 42 of one of the extending segments 30 of the first extension portion 26*a* and the inner side 42 of one of the extending segments 30 of the second extension portion 26*b*. The chin strap 50 can be connected or secured to the inner sides 42 of the extending segments 26*a*, 26*b* by snaps, fasteners, rivets, screws, or similar connectors, as are known in the art. For example, the chin strap 50 can include snap connectors (not shown) that removably attach to corresponding snap connectors (not shown) on the inner surfaces 42 of the extending segments 30 of the extension portions 26*a*, 26*b* of the helmet 10, 110. In some examples, the chin strap 50 comprises a band 52 formed from a soft, flexible material, such as fabric, tubular webbing, silicone, rubber, or similar materials. The chin strap 50 further comprises a pocket 54 configured to be secured to the wearer's chin 3. The pocket 54 can be integral with the band 52 of the chin strap 50, as shown in FIGS. 1, 2, 4, and 5. In other examples, the pocket 54 can be a separate structure, which can be formed from a different type of material from the band 52. In such cases, the pocket 54 can be removably or fixedly connected to the band 52 by fasteners, connectors, and/or adhesives, as are known in the art.

With reference to FIG. 3, in some example, the helmet 10 further comprises interior padding 56 connected to and extending inwardly from inner sides of the plurality of tubular segments 18, 24 of the cap portion 16. The interior padding 56 defines an enclosure or cavity for receiving at least a portion of the wearer's head 2. For example, the interior padding 56 can comprise inflatable bladders or cushions 58 mounted to the inner sides of the tubular segments 18, 24 of the frame 12. The inflatable bladders or cushions 58 can enclose an empty space and can be configured to be inflated by a fluid (e.g., a liquid, gas, and/or a gel). The inflatable bladders or cushions 58 can be configured to absorb forces applied to portions of the frame 12 of the helmet 10, 110 to prevent the external forces from being exerted on the wearer's head 2. The inflatable bladders or cushions 58 can be formed from a flexible material capable of expanding to a sufficient size to provide sufficient protection for the wearer's head 2. For example, the inflatable bladders or cushions 58 can be formed from a stretchable elastomeric material, such as silicone. In some examples, the inflatable bladders or cushions 58 are fully sealed and enclosed structures that cannot be inflated or deflated once sealed and attached to the frame 12 of the helmet 10, 110. In other examples, the inflatable bladders or cushions 58 can comprise and/or be fluidly connected to a nozzle 60 for inflating or deflating the inflatable bladders or cushions 58.

In some examples, interior padding 56 comprises multiple inflatable bladders or cushions 58 positioned throughout the interior or cavity 14 of the frame 12. The multiple inflatable bladders or cushions 58 can be connected by conduits or tubes 62 extending from the nozzle 60 to the multiple inflatable bladders or cushions 58, such that interiors of each of the inflatable bladders or cushions 58 are fluidly connected together. Fluidly connecting the inflatable bladders or cushions 58 together can simplify manufacture of the helmet 10, 110 since the multiple inflatable bladders or cushions 58 can be inflated simultaneously through the single nozzle 60. Also, the multiple inflatable bladders or cushions 58 can be stronger and more resistant to breaking because only one nozzle 60 is present. The single nozzle 60 can be configured to seal either automatically or manually after the bladders or cushions 58 are inflated to a desired pressure. Further, interconnected inflatable bladders or cushions 58 may be better able to absorb impact forces than individually sealed bladders or cushions 58, because as one bladder or cushion 58 compresses, air from the compressed bladder or cushion 58 is free to move through the conduits 62 to other bladders or cushions 58. In contrast, for a helmet 10, 110 comprising multiple independent bladders or cushions 58, each bladder or cushion 58 is separately inflated and sealed, meaning that the bladder or cushion 58 may pop if an excessive impact force is applied to the helmet 10, 110.

In some examples, the only padding on the helmet 10, 110 is provided by the arrangement of inflatable bladders 58. It is believed that including only inflatable bladders 58 makes the helmet 10, 110 feel less restrictive and more minimalist for wearers. Also, it is believed that extensive padding may contribute to the water braking effect that the helmet 10, 110 attempts to avoid. However, alternatively or in addition, the interior padding 56 can include other non-inflated or inflatable pads formed from soft materials, such as foam, neoprene, cotton cloth, cotton batting, and other soft materials for cushioning the wearer's head 2 and for comfort.

The inflatable bladders or cushions 58 and additional padding, if present, can be positioned in a variety of positions and arrangements over the interior of the frame 12. For example, the helmet 10 can include one or more of the following cushions: a top cushion configured to contact parietal region of the wearer's head 2, right and left cushions configured to contact temporal regions of the wearer's head 2, a front cushion configured to contact a frontal region of the wearer's head 2, and a rear cushion configured to contact the occipital region of the wearer's head 2. The bladders or cushions 58 can be provided in a variety of shapes including circles, ellipses, regular or irregular polygons, or any other shape selected to provide support and protection for selected regions of the wearer's head 2. For example, as shown in FIG. 3, one or more of the bladders or cushions 58 can be shaped like a cross. In other examples, cushions can the "T"-shaped, "H"-shaped, or provided in any other shape or configuration.

Figure 10:
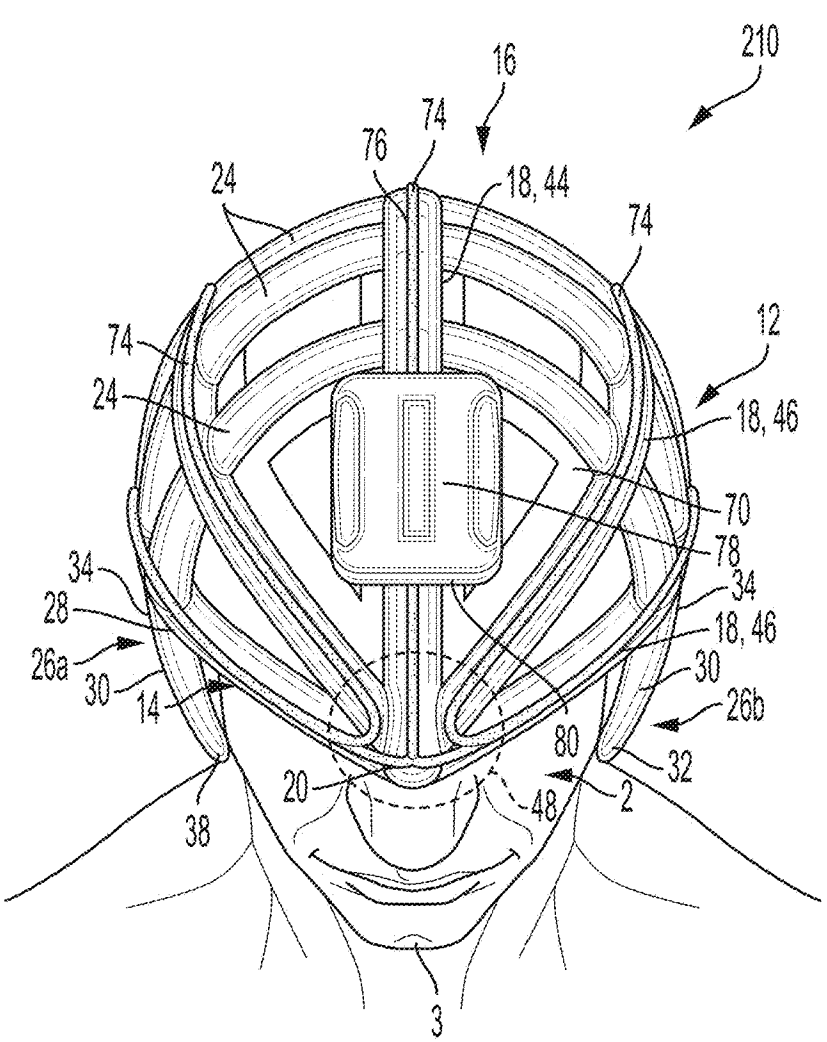
FIG. 10 is a perspective view of a front portion of the helmet of FIG. 9 worn by the wearer.
Figure 14:
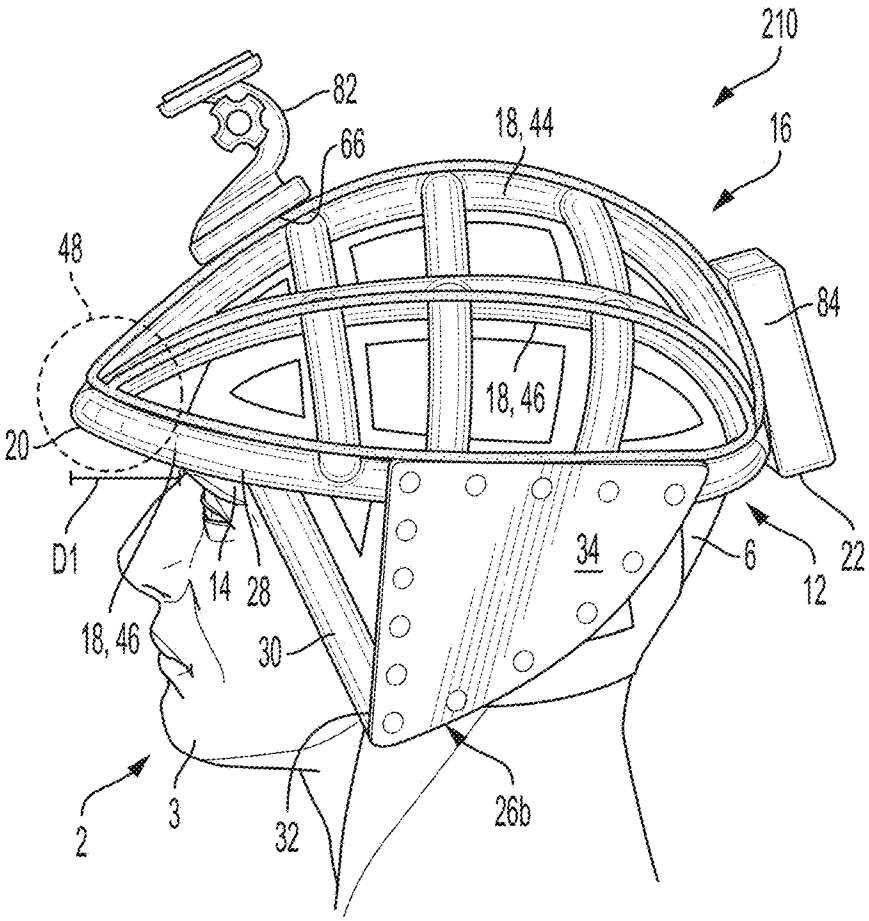
FIG. 14 is a side view of the helmet and wearer of FIG. 13.
Figure 13:
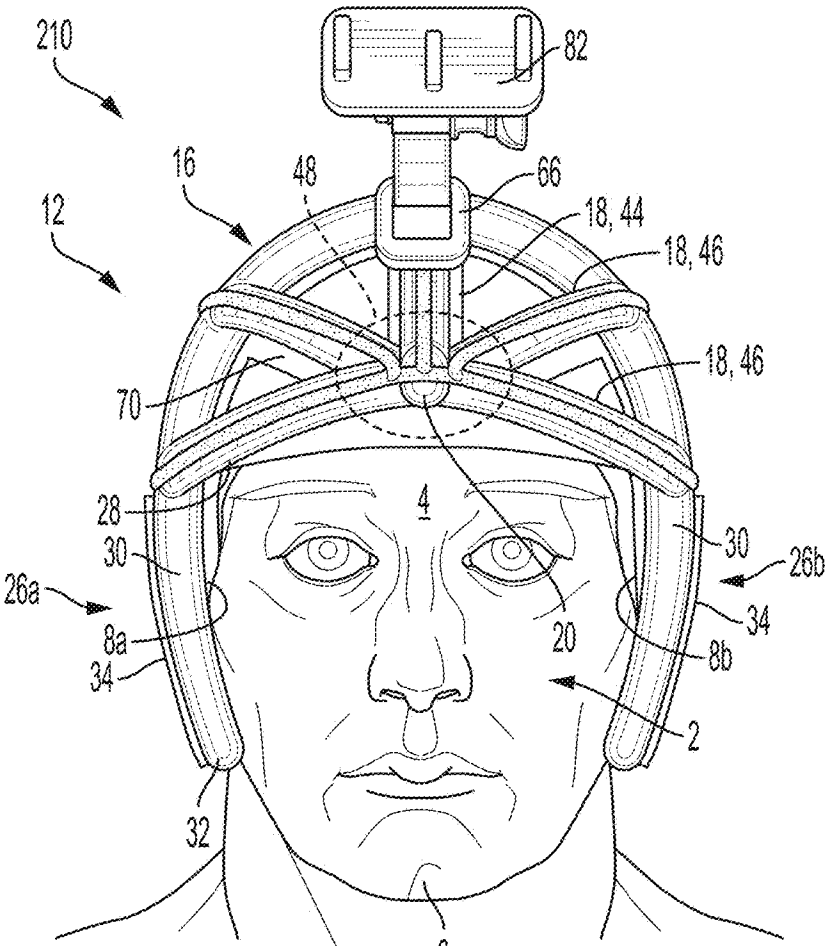
FIG. 13 is a front view of the helmet of FIG. 9 including a camera support, according to an aspect of the present disclosure.
Figure 16:
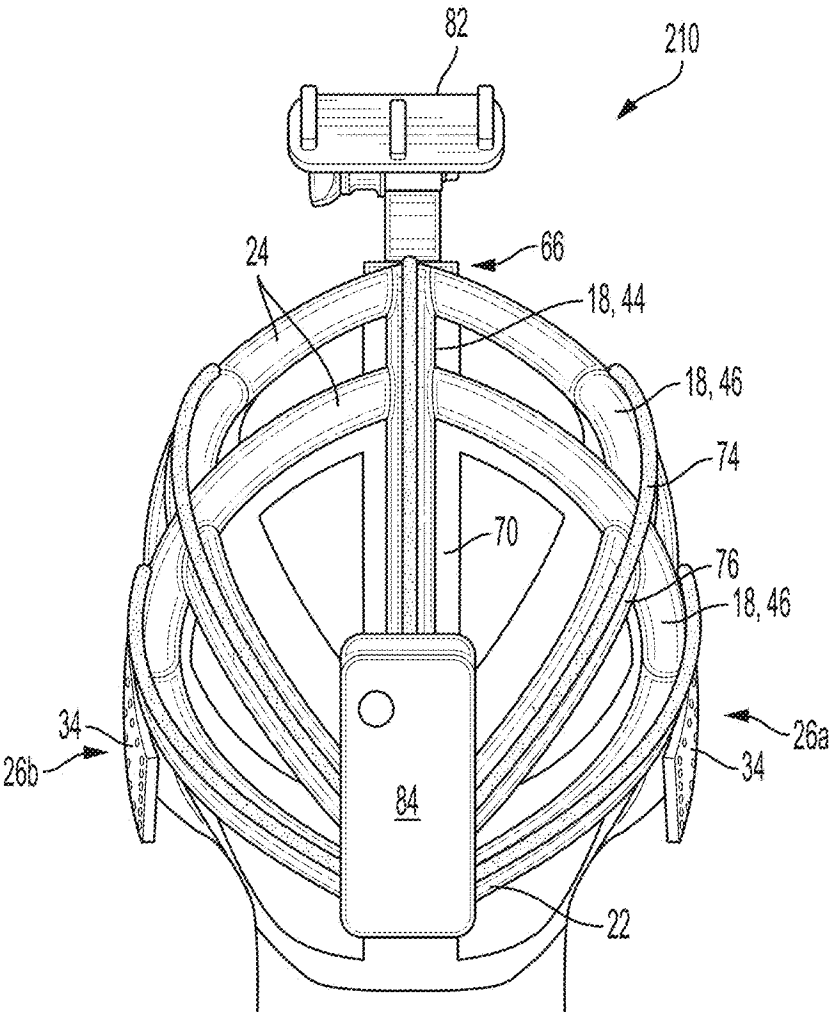
FIG. 16 is a rear view of the helmet of FIG. 15.

In some examples, the helmet 10, 110 further comprises a mounting bracket 66 extending from an outwardly facing side of one of the segments 18, 24 of the cap portion 16. As shown in FIGS. 1, 2, 4, and 5, the mounting bracket 66 comprises a ring 68. The ring 68 can be formed from metal or from a rigid plastic material. The ring 68 can be configured to anchor or secure an electronic device, such as a power source for a lighting system or camera to the helmet 10, 110. An exemplary camera support or mounting device is shown in FIGS. 13, 14, and 16. An exemplary power source for a lighting system is shown in FIG. 10.

Another example of a helmet 210 is shown in FIGS. 9-16. As in previous examples, the helmet 210 comprises a frame 12 comprising hollow tubular segments 18, 24, 30 arranged to form a plurality of enclosed spaces or cells. The frame 12 of FIGS. 9-16 can include a cap portion 16 defining an interior or cavity 14 sized to fit over the wearer's head 2, which comprises the main tubular segments 18 extending from the front 20 of the helmet 210 to the back 22 of the helmet 210. The cap portion 16 also includes the cross segment 24 extending between two or more of the main segments 18. The frame 12 also comprises the extension portions 26*a*, 26*b* similar in shape and configuration to previously described extension portions. Also, as in previous examples, the helmet 210 comprises the perforated cover plates 34 mounted to extending tubular segments 30 of the extension portions 26*a*, 26*b*. As in previous examples, the cover plates 34 are configured to cover the right and left ears 8*a*, 8*b* and at least a portion of the squamous temporal bones of the wearer's head 2.

Lacerations of the forehead 4 and around the orbit of the eye are relatively common injuries for surfers that can be caused, for example, by impacts with the fins, nose, or rail of the surfboard. In order to provide protection for such lacerations, in some examples, the cap portion 16 of a helmet 210 can include or define a peaked forehead portion 48 or brim on the front 20 of the helmet 210 that provides forehead/orbital protection. The peaked forehead portion 48 can be formed by portions of the center segment 44 and ribs 46 that extends substantially beyond the wearer's forehead 4 forming a point, peak, or brim. For example, peaked forehead portion 48 may extend beyond the wearer's forehead 4 by a distance D1 sufficient to protect the wearer's forehead 4 from various types of impacts that can occur during watersport activities, such as surfing. In particular, the peaked forehead portion 48 can be positioned to prevent objects, such as a surfboard (i.e., the wearer's surfboard or someone else's surfboard), boat, Jet Ski, the ocean floor, or any other hard object, from striking the wearer's face, eyes, or forehead 4. Instead, the object may contact the peaked forehead portion 48 of the helmet 210 preventing significant injury to the wearer. For example, the distance D1 can be from about 2.5 cm to about 10 cm, or from about 5 cm to about 7.5 cm, or at least about 2.5 cm, to provide suitable protection for the wearer's forehead 4.

Figure 15:
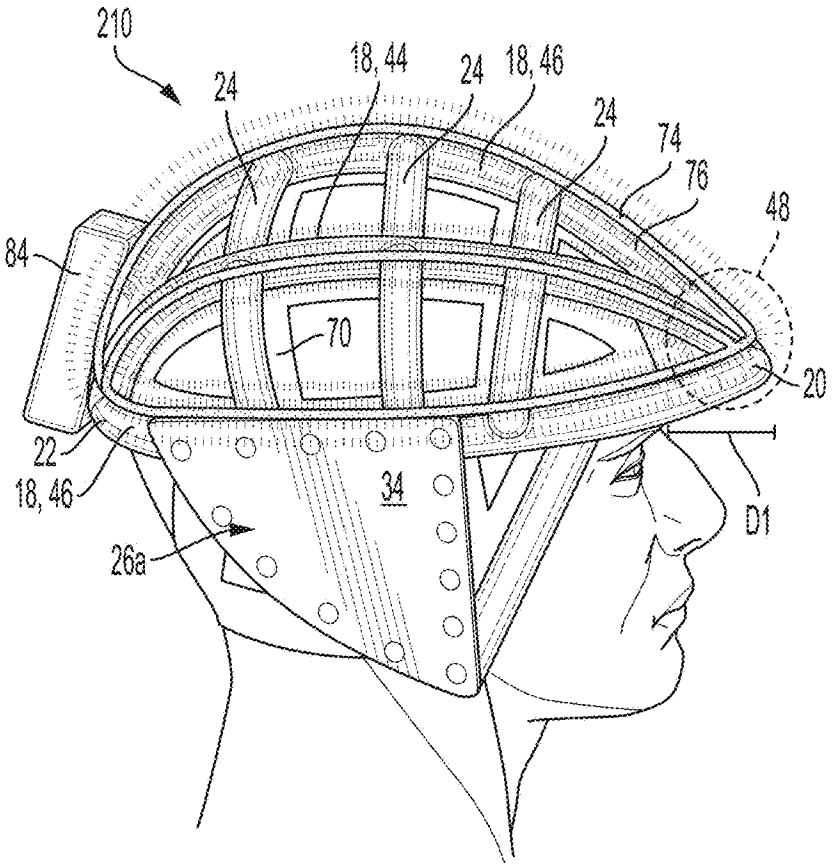
FIG. 15 is a side view of the helmet of FIG. 9 including both a camera support and a lighting system, according to an aspect of the present disclosure.

The helmet 210 also comprises the interior padding portion 56 that is mounted to inner surfaces of the segments 18, 24 of the cap portion 16. However, unlike in the helmets 10, 110 of FIGS. 1-5, the interior padding portion 56 of the helmet 210 comprises a liner 70 formed from interconnected segments connected together to form spaces or cells. The segments of the liner 70 are formed from a soft cushioning material, such as foam, cotton, neoprene, or similar materials, as are known in the art. In some examples, portions of the liner 70 can be inflatable, including a nozzle 60 for inflating the portions of the liner 70 to a size customized for a particular wearer. The liner 70 is configured to enclose and/or cradle the wearer's head 2 ensuring that the segments 18, 24 of the frame 12 remain spaced apart from the wearer's head 2 during impacts. As shown most clearly in FIGS. 14 and 15, some of the segments of the liner 70 are aligned with corresponding segments 18, 24 of the frame 12. For example, portions of the liner 70 near the crown-point or top of the wearer's head 2 are generally positioned directly below segments 18, 24 of the frame 12. Other portions of the liner 70, particularly portions of the liner proximate to the forehead portion 48 of the helmet 210, are spaced apart from segments 18, 24 of the frame 12. For example, the liner 70 can contact wearer's forehead 4, and can be spaced apart from segments 18 forming the forehead portion 48 of the frame 12 by the distance D1. As shown in FIGS. 14 and 15, the liner 70 can also include a rear cradle portion 72. The cradle portion 72 of the liner 70 extends below the lower edge 28 of the cap portion 16 and cradles the occipital region 6 of the wearer's head 2, thereby providing added protection for the occipital region 6 of the wearer's head 2 without restricting the wearer's ability to turn his or her head (i.e., to move his or her head 2 left or right, up or down).

Figure 9:
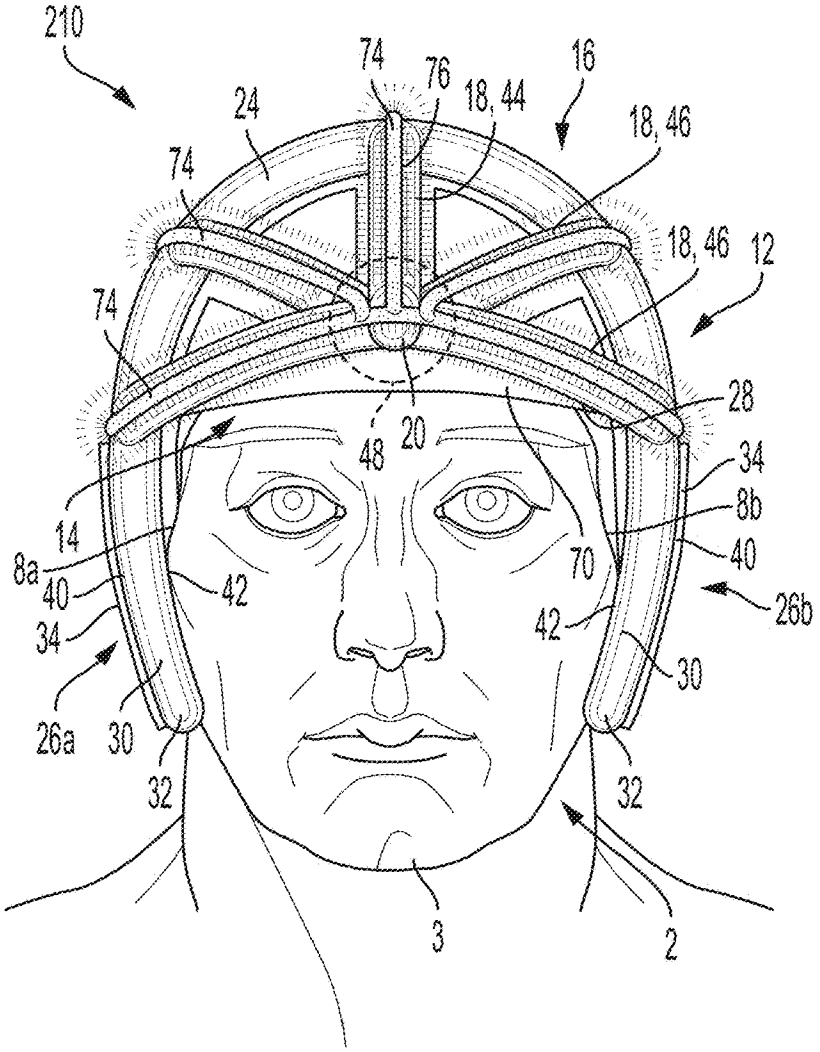
FIG. 9 is a front view of another example of a helmet configured to protect at least portions of the squamous temporal bones of the wearer including a lighting system, according to an example of the present disclosure.
Figure 12:
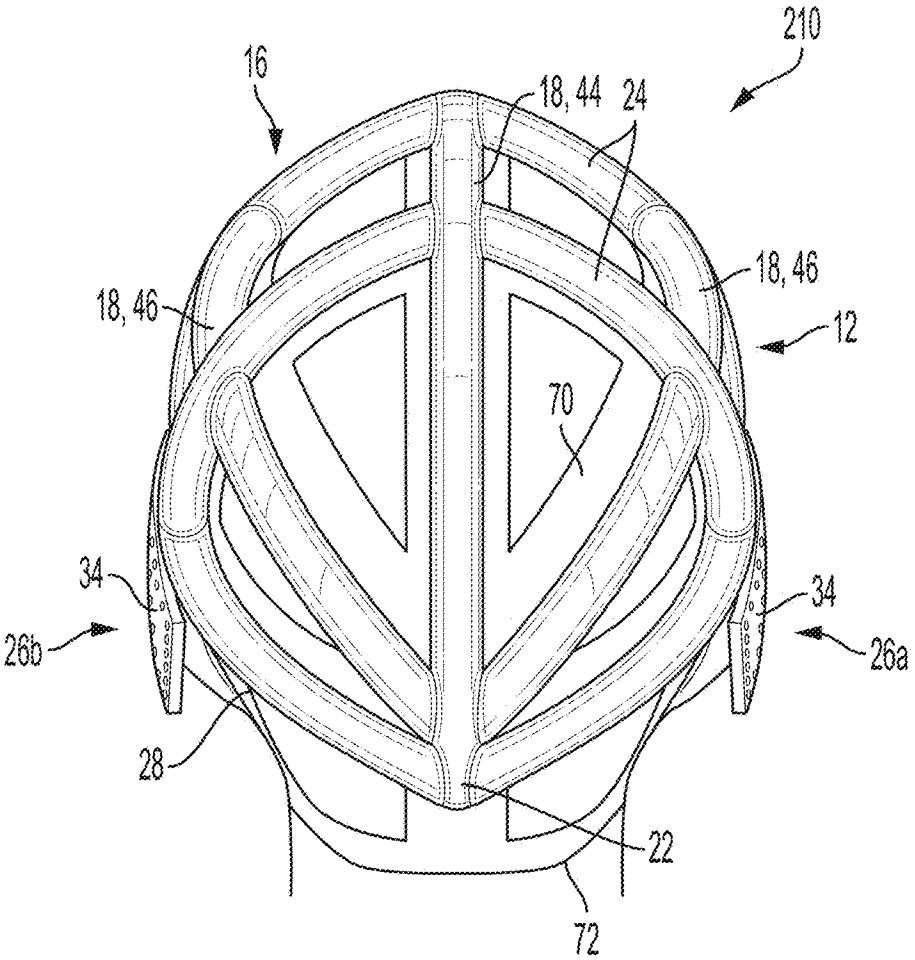
FIG. 12 is a rear view of the helmet of FIG. 9.
Figure 11:
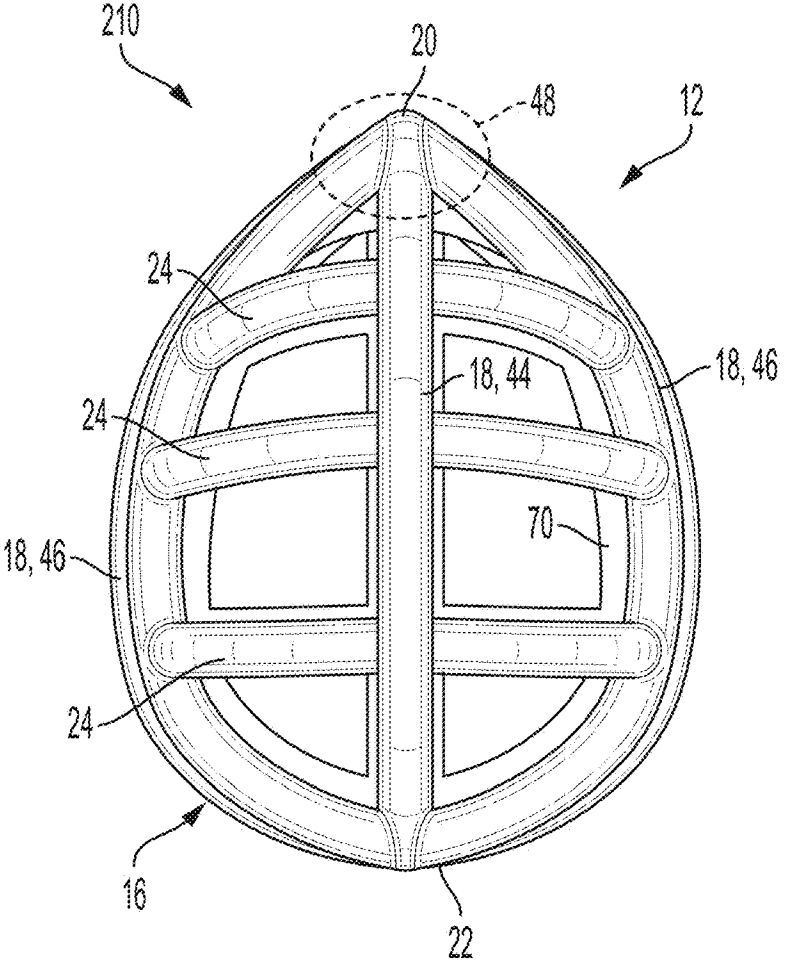
FIG. 11 is a top view of the helmet of FIG. 9.

In some examples, with specific reference to FIGS. 9 and 10, the helmet 210 further comprises a lighting system that improves safety by increasing visibility of the wearer to others. It is believed that by increasing visibility of the wearer, other surfers are less likely to run into the wearer or to accidently hit the wearer with their surfboards or other equipment. The lighting system can comprise electroluminescent wires 74 connected to and/or embedded in and extending along the plurality of segments 18, 24, 30 of the frame 12. For example, the segments 18, 24, 30 can comprise axially extending grooves 76 sized to receive segments of the electroluminescent wires 74. The wires 74 can be fully or partially positioned in the grooves 76 so that the wires 74 do not protrude from or extend beyond an outer surface of the tubular segments 18, 24, 30, giving the helmet 210 a streamlined appearance. The electroluminescent wires 74 can comprise segments of a thin copper wire coated by a luminescent material, such as a phosphor, that glows when an electrical current is applied through the thin copper wire. When illuminated, the electroluminescent wires produce a 360-degree unbroken line of visible light in a variety of colors. Due to the thin diameter of the wires 74, the wires are flexible, meaning that the wires 74 can be easily bent to conform to curvature of the segments 18, 24, 30 of the frame 12.

In some examples, the lighting system further comprises a power source 78, such as a small battery supply, comprising a rigid plastic housing 80 mounted to the frame 12 of the helmet 210. For example, the power source 78 can be mounted to the ring 68 shown in FIGS. 1, 2, 4, and 5 or to any other convenient mounting structured attached to the frame 12. Several hundred feet of electroluminescent wire can be powered by one or two AA batteries for several hours. Therefore, the power source housing 80 only needs to be large enough to contain or enclose, for example, one or two size AA batteries. In other examples, the power source 78 can be smaller sized, for example, to enclose watch or coin batteries, such as zinc or lithium ion batteries, as are commonly used for small electronic devices (e.g., watches).

With reference to FIGS. 13 and 14, in some examples, the helmet 210 comprises a camera support 82 mounted to the frame 12. For example, the camera support 82 can be mounted to the ring 68 shown in FIGS. 1, 2, 4, and 5, or to any other convenient mounting bracket or connector attached to the helmet 210. As shown in FIGS. 13 and 14, the camera support 82 can be configured to pivot or twist to adjust a field of view of or a camera attached thereto. In some examples, the camera support 82 may also include a hinge or telescoping portion for adjusting a height of the camera relative to the frame 12 of the helmet 210. The helmet 210 can also include a power supply and/or controller 84 for the camera. As shown in FIGS. 13 and 14, the controller 84 is mounted to the frame 12 proximate to the back 22 of the helmet 210. The controller 84 can include electronic circuitry for controlling the camera, such as circuitry for turning the camera on or off and/or for adjusting parameters of the camera (e.g., shutter speed, resolution, brightness, contrast, flash settings, etc.). The controller 84 can also contain memory for storing images and/or videos captured by the camera and/or a wireless transmitter (e.g., a cellular transceiver) for transmitting captured images from the controller 84 to a remote device. The controller 84 can also contain a battery for providing power to the camera and/or other electronic components of the camera or controller 84. The controller 84 can be a dedicated electronic device that is provided with the helmet 210 specifically for controlling electronic devices made for and/or provided with the helmet 210. In other examples, the controller 82 can be a general-purpose electronic or computer device including computer software for controlling the camera and/or any other electronic devices or systems connected to the helmet 210. For example, the controller 82 can be a smartphone, smartwatch, fitness tracker, or other portable/wearable electronic device, as are known in the art, configured to control the camera and/or lighting system.

In some examples, as shown in FIGS. 15 and 16, the helmet 210 can comprise both the lighting system comprising the electroluminescent wires 74 and the camera support 82 mounted to the frame 12. In that case, the controller 84 mounted proximate to the back 22 of the helmet 210 can control and provide power for the camera and can also provide power for the electroluminescent wires 74 of the lighting system. In other examples, the helmet 210 may include both a power supply 78 for the lighting system and a separate controller 84 for the camera.

Although the disclosure has been described in detail for the purpose of illustration based on what is currently considered to be the most practical and preferred embodiments, it is to be understood that such detail is solely for that purpose and that this disclosure is not limited to the disclosed embodiments, but, on the contrary, is intended to cover modifications and equivalent arrangements. Furthermore, it is to be understood that the present disclosure contemplates that, to the extent possible, one or more features of any embodiment can be combined with one or more features of any other embodiment.

What is claimed is:

1. A helmet comprising:

a frame comprising a plurality of tubular segments arranged to form a plurality of enclosed spaces, wherein the plurality of tubular segments comprise hollow tubes having a rigid circumferential exterior surface, the frame comprising:

a cap portion defining an interior sized to fit over a head of a wearer, the cap portion comprising a plurality of main tubular segments extending from a front of the helmet, configured to be positioned over a forehead of the wearer, to a back of the helmet, configured to be positioned over an occipital region of the wearer's head, and at least one tubular cross segment extending between the plurality of main tubular segments; and at least one extension portion comprising extending tubular segments of the plurality of tubular segments that extend from a lower edge of the cap portion to a common point that is configured to be positioned below the wearer's ear, wherein the extending tubular segments and the lower edge of the cap portion are configured to define a space sized to be positioned over the wearer's ear and squamous temporal bones of the wearer's head;

an interior padding portion connected to the rigid circumferential exterior surface of the plurality of tubular segments and extending inwardly to define the interior of the cap portion; and at least one plate comprising one or more perforations, wherein the at least one plate is mounted to the rigid circumferential exterior surface of the extending tubular segments of the at least one extension portion, the at least one plate being configured to cover the wearer's ear and at least a portion of the squamous temporal bones of the wearer's head.

2. The helmet of claim 1, wherein the helmet is buoyant for use in watersports.

3. The helmet of claim 1, wherein the frame comprises a molded frame in which the plurality of tubular segments are integrally formed.

4. The helmet of claim 1, wherein the plurality of tubular segments are hollow.

5. The helmet of claim 1, wherein the plurality of tubular segments comprise high density polyethylene.

6. The helmet of claim 1, wherein the plurality of main tubular segments comprise a center segment that extends from the front of the helmet to the back of the helmet and is configured to extend over a crown-point or vertex of the wearer's skull, and a plurality of branched ribs that extend from a front portion of the center segment to a rear portion of the center segment configured to curve about the crown point or vertex of the wearer's head.

7. The helmet of claim 1, wherein the at least one plate is mounted to an outwardly facing side of the rigid circumferential exterior surface of the extending tubular segments of the at least one extension portion such that an inner surface of the at least one plate is spaced apart from an inwardly facing side of the rigid circumferential exterior surface of the extending tubular segments by a distance of at least about 10.0 mm.

8. The helmet of claim 1, wherein the at least one plate comprises a rigid plastic sheet, and wherein the one or more perforations comprise a plurality of openings extending through the rigid plastic sheet.

9. The helmet of claim 1, wherein the cap portion comprises a peaked forehead portion on the front of the helmet that provides forehead/orbital protection, the peaked forehead portion formed from at least one main tubular segment of the plurality of tubular segments having a front end configured to extend beyond the wearer's forehead, when the helmet is worn on the wearer's head, such that the front end of the at least one main tubular segment is configured to be spaced apart from the wearer's forehead.

10. The helmet of claim 9, wherein the interior padding portion comprises a liner connected to one or more of the plurality of tubular segments of the frame, and wherein an outwardly facing surface of the liner is spaced apart from the front end of the at least one main tubular segment of the peaked forehead portion of the frame by a distance of at least 2.0 cm.

11. The helmet of claim 1, wherein the interior padding portion comprises a plurality of inflatable cushions mounted to an inwardly facing side of the plurality of tubular segments of the frame.

12. The helmet of claim 11, further comprising a nozzle for inflating the plurality of inflatable cushions, and a plurality of conduits mounted to portions of the plurality of tubular segments of the frame fluidly connecting the plurality of inflatable cushions together for passing fluid from the nozzle to the plurality of inflatable cushions.

13. The helmet of claim 12, wherein the plurality of inflatable cushions comprise a top cushion configured to contact parietal region of the wearer's head, right and left cushions configured to contact temporal regions of the wearer's head, a front cushion configured to contact a frontal region of the wearer's head, and a rear cushion configured to contact the occipital region of the wearer's head.

14. The helmet of claim 1, wherein the at least one extension portion comprises a first extension portion configured to be positioned over the wearer's right ear and a second extension portion configured to be positioned over the wearer's left ear, the helmet further comprising a chin strap connected between the rigid circumferential exterior surface of the first extension portion and the rigid circumferential exterior surface of the second extension portion, which is configured to secure the helmet to the wearer's head.

15. The helmet of claim 14, wherein the chin strap is connected between an inwardly facing side of the rigid circumferential exterior surface of one of the extending tubular segments of the first extension portion and an inwardly facing side of the rigid circumferential exterior surface of one of the extending tubular segments of the second extension portion.

16. The helmet of claim 1, further comprising electroluminescent wires positioned in axially extending grooves of the plurality of tubular segments, such that the electroluminescent wires do not protrude beyond the rigid circumferential exterior surface of the plurality of tubular segments, and a power source mounted to the frame of the helmet electrically connected to the electroluminescent wires for providing electrical current to cause the wires to luminesce.

17. The helmet of claim 1, wherein the plurality of tubular segments comprise carbon fiber.

18. The helmet of claim 1, wherein the plurality of tubular segments are transparent or translucent.

19. The helmet of claim 1, wherein the plurality of tubular segments having an outer diameter of about 10.0 mm to about 20.0 mm.

20. The helmet of claim 1, further comprising a mounting bracket mounted to an outwardly facing side of the rigid circumferential exterior surface of one of the plurality of tubular segments for anchoring an electronic device to the helmet.

* * * * *